US005727349A

United States Patent [19]

McLaughlin

[11] Patent Number: 5,727,349

[45] Date of Patent: Mar. 17, 1998

[54] SHELL AND DOOR FRAME WITH DOOR PANEL ASSEMBLY FOR ENCLOSED INSULATIVE PANEL CONSTRUCTION

[76] Inventor: Randolph W. McLaughlin, Rte. 1, Box 14BB, Stringer, Miss. 39481

[21] Appl. No.: 692,975

[22] Filed: Aug. 6, 1996

[51] Int. Cl.[6] ..... E06B 3/00

[52] U.S. Cl. ..... 49/501; 49/504; 49/371

[58] Field of Search ..... 49/371, 501, 504; 52/79.1; 428/68, 71, 75

[56] References Cited

U.S. PATENT DOCUMENTS

| | | |
|---|---|---|
| 1,227,577 | 5/1917 | Brewer . |
| 1,902,499 | 3/1933 | Herreshoff . |
| 2,927,352 | 3/1960 | Chenoweth . |
| 3,618,261 | 11/1971 | Torbett . |
| 3,894,357 | 7/1975 | Stanfield . |
| 3,963,269 | 6/1976 | Rosenberg . |
| 4,763,499 | 8/1988 | Boyle . |
| 4,796,445 | 1/1989 | Norden, Jr. . |
| 5,077,940 | 1/1992 | LaRose, Jr. . |
| 5,141,046 | 8/1992 | Duncan . |
| 5,154,461 | 10/1992 | Prescott et al. . |
| 5,424,118 | 6/1995 | McLaughlin . |

*Primary Examiner*—Kenneth J. Dorner
*Assistant Examiner*—Curtis Cohen
*Attorney, Agent, or Firm*—David H. Semmes

[57] ABSTRACT

For refrigeration units such as walk-in coolers and freezers, a shell, door frame and door panel assembly adapted to enclosed insulative panel constructions wherein the shell confines a selected standard and/or oversize door frame. The door frames are of composite plastic and steel construction including lightweight external plastic hardtracks forming top, sides and screed bottom, the purposes of the external construction being to confine frame elements which are formed of steel, such that by virtue of the separation of elements forming jamb frames and header frames, applied insulation to the overall assembly is rendered most effective. The standard and oversize door panel assemblies are adapted to encompass a precut retainer by means of inside and outside panels, the latter of which contains backup plates for hinges and for door closers and the like.

5 Claims, 7 Drawing Sheets

FIG. 2
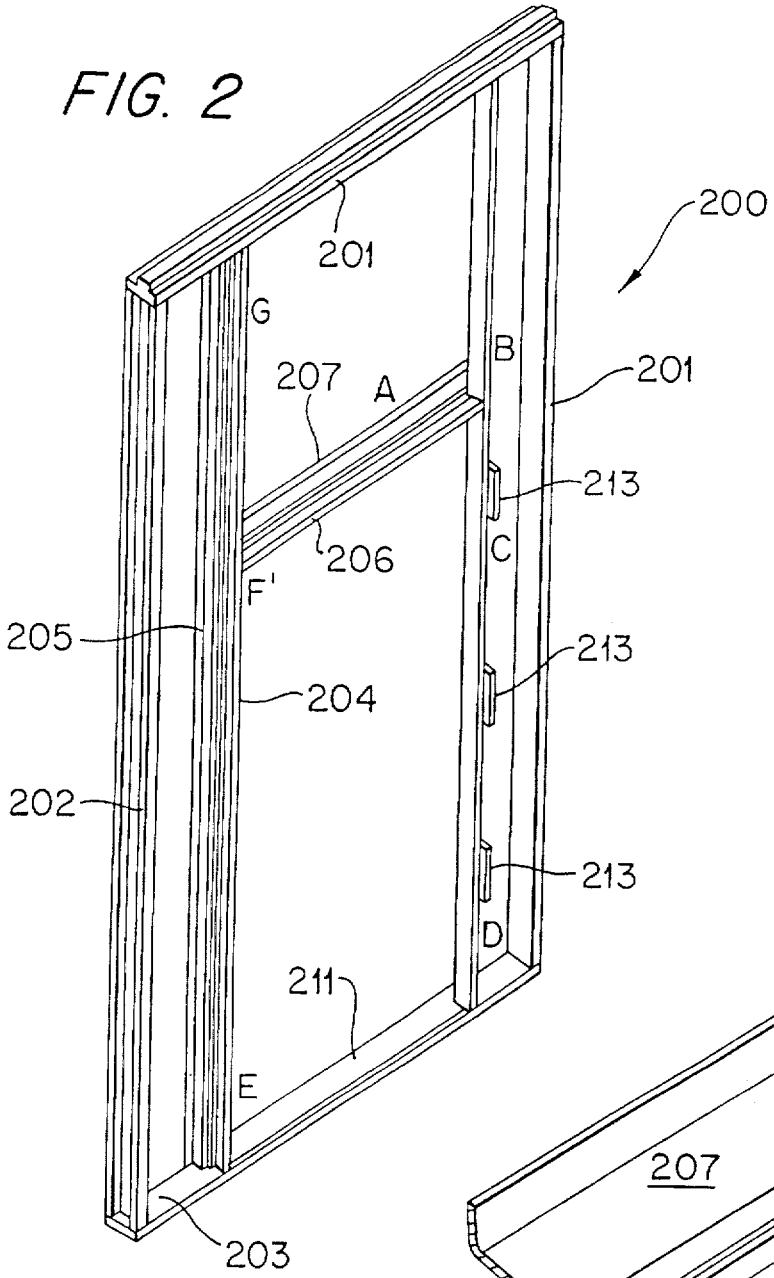
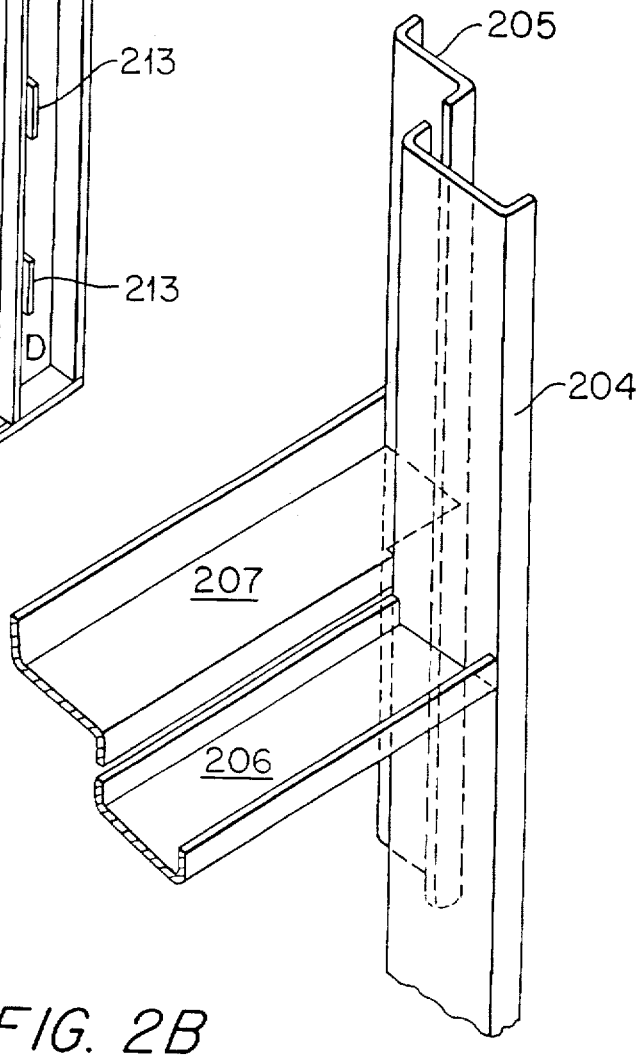
FIG. 2B

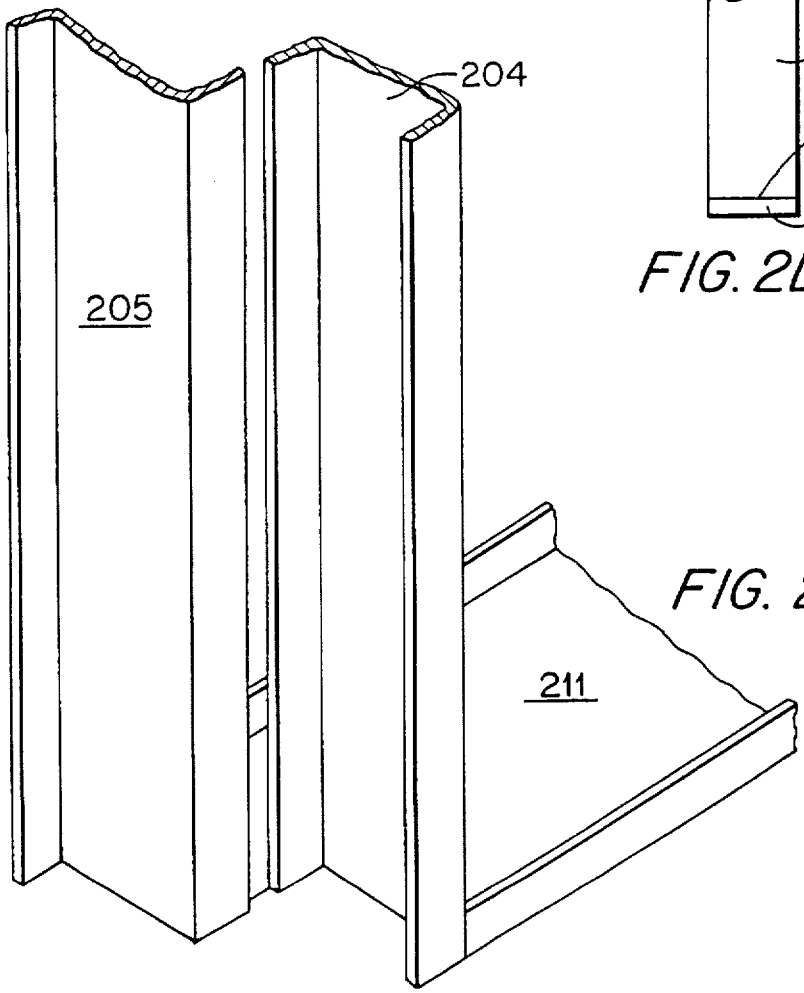
FIG. 2A
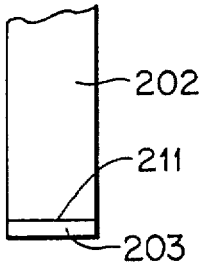
FIG. 2D-E
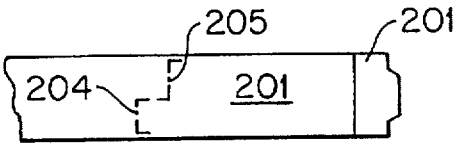
FIG. 2B-C
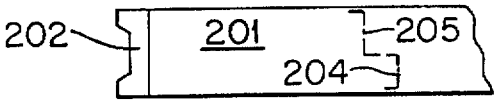
FIG. 2F-E
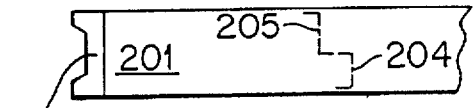
FIG. 2G-F
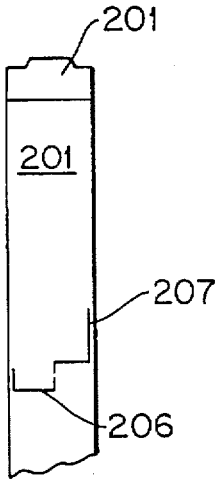
FIG. 2B-A
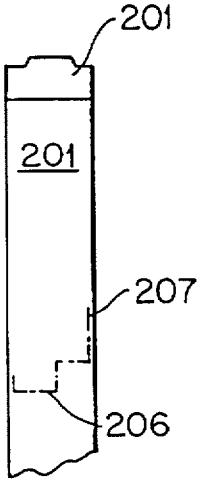
FIG. 2A-F

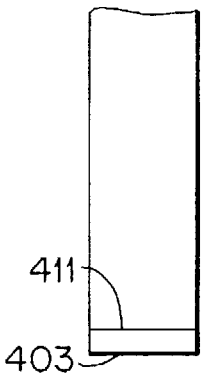
FIG. 4D-E
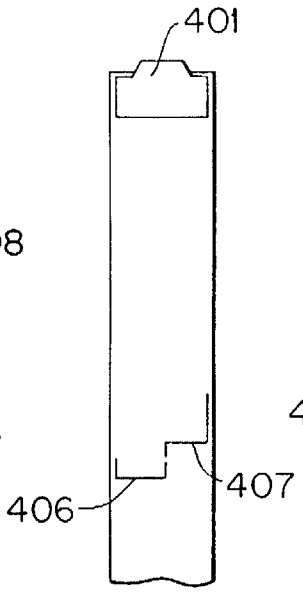
FIG. 4A-H
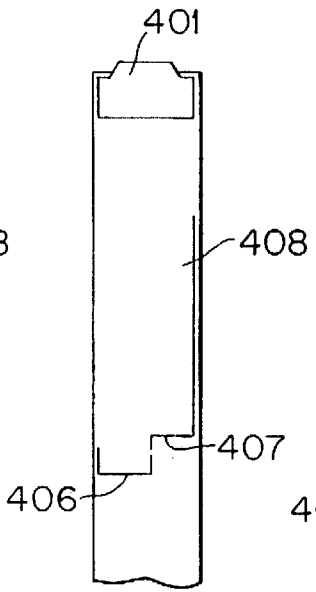
FIG. 4H-F
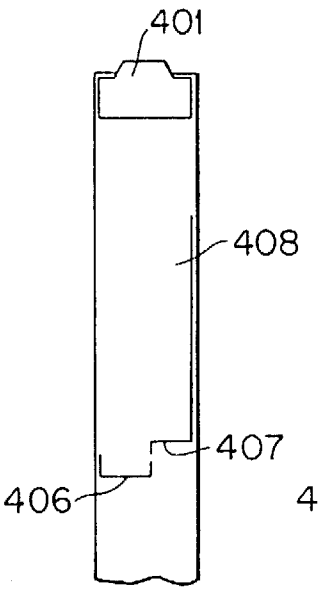
FIG. 4B-A
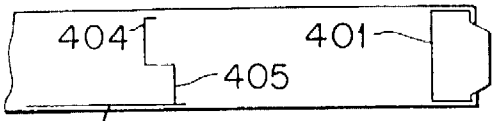
FIG. 4C-B
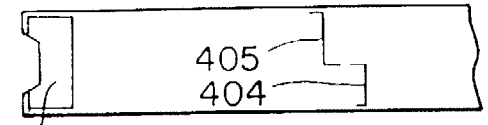
FIG. 4F-E
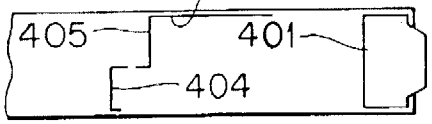
FIG. 4B-C
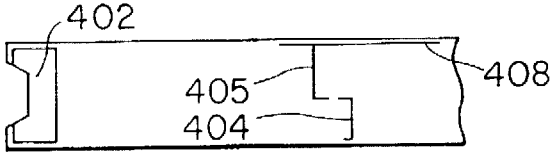
FIG. 4G-F

SHELL AND DOOR FRAME WITH DOOR PANEL ASSEMBLY FOR ENCLOSED INSULATIVE PANEL CONSTRUCTION

BACKGROUND OF THE INVENTION

This invention is related to refrigeration units such as walk-in coolers and freezers. It provides a sheetmetal shell door frame, and a door for such units which are otherwise comprised of linked-together insulative panels. These panels are characterized by a densifted urethane perimeter and core of low-density insulating urethane, abutting the perimeter and generally they are held in place by thin rigid outer skin. The densifted urethane perimeters of the panels have a tongue and groove configuration as well as firm locking means, securing the abutting panels together. The principles underlying such prior art assemblage are shown in U.S. Pat. No. 5,424,118 dated Jun. 13, 1995. Likewise, that patent defines a urethane foaming technique which is utilized in the construction of this composite sheetmetal shell door frame and door panel assembly. Whereas the invention defines standard door panel frame assemblies and related sheetmetal shells, it also encompasses assemblage of oversize door frames and door panel assemblies. Standard size door frames are conventionally assembled to accommodate a door which is under 44 inches in width, whereas oversize doors exceed the standard door in width. The invention is thus characterized by its adaptation to thermal barrier enclosures which are formed of individual insulative panels having a densified urethane perimeter and a core of low-density insulating urethane abutting the perimeter and held in place by a thin semi-rigid outer skin.

SUMMARY OF INVENTION

The present invention encompasses the assembly and utility of a shell, door frame with door panel for enclosed insulative panel constructions of the type illustrated in U.S. Pat. No. 5,424,118. Its features include exterior and interior shell members which confine either standard or oversize door frames, the frames accommodating a reinforced door. By construction, the door frame is protected against racking, distortion, warping and twisting in transit during storage, installation and/or use. To accomplish the objectives of the invention, heavy 12-gauge steel strips are fitted into an exterior metal door pan to act as backdrops for hardware, evenly distributing the weight of the door across its entire width. Moreover, heavy 14-gauge reinforcing steel U-channel frame members yield extra support and rigidity to the door, as indicated. Furthermore, backup plates of 12-gauge steel are welded to the U-channel frame to serve as hinge latch and door closer anchorments.

THE PRIOR ART

| INVENTOR | DATE | U.S. PAT. NO. | DESCRIPTION |
|---|---|---|---|
| Brewer | 1917 | 1,227,577 | Frame |
| Herreshoff | 1933 | 1,902,499 | Vehicle Body Door Stiffener |
| Chenoweth | 1960 | 2,927,352 | Prefabricated Door and Door Frame |
| Torbett | 1971 | 3,618,261 | Pre-Hung Door Assembly |
| Stanfield | 1975 | 3,894,357 | Security Door |
| Rosenberg | 1976 | 3,963,269 | Secunty Device |
| Boyle | 1988 | 4,763,499 | Door Security System |
| Norden, Jr. | 1989 | 4,796,445 | Door Locking Mechanism |
| LaRose, Jr. | 1992 | 5,077,940 | Door security Apparatus |
| Duncan | 1992 | 5,141,046 | Security Screens |

-continued

| INVENTOR | DATE | U.S. PAT. NO. | DESCRIPTION |
|---|---|---|---|
| Prescott et al. | 1992 | 5,154,461 | Door Secured System |

DESCRIPTION OF THE DRAWINGS

FIG. 2 illustrates in perspective a standard door frame assembly of the type which fits into the door frame of FIG. 1; FIG. 2 views B–C, F–E, G–F, B–A, A–F, and D–E are schematic sections of the assembled standard size door frame components. FIGS. 2A and 2B are enlarged segments of the elements forming respectively the jamb and header frames which confine the threshold.

FIGS. 4C–B; 4F–E; 4B–C; 4G–F; 4B–A; 4H–F; 4A–H and 4D–E are schematic representations of sections of FIG. 4, taken along the section lines which are represented in FIG. 4 by the alpha-numerics.

DESCRIPTION OF PREFERRED EMBODIMENTS

Figure 1:
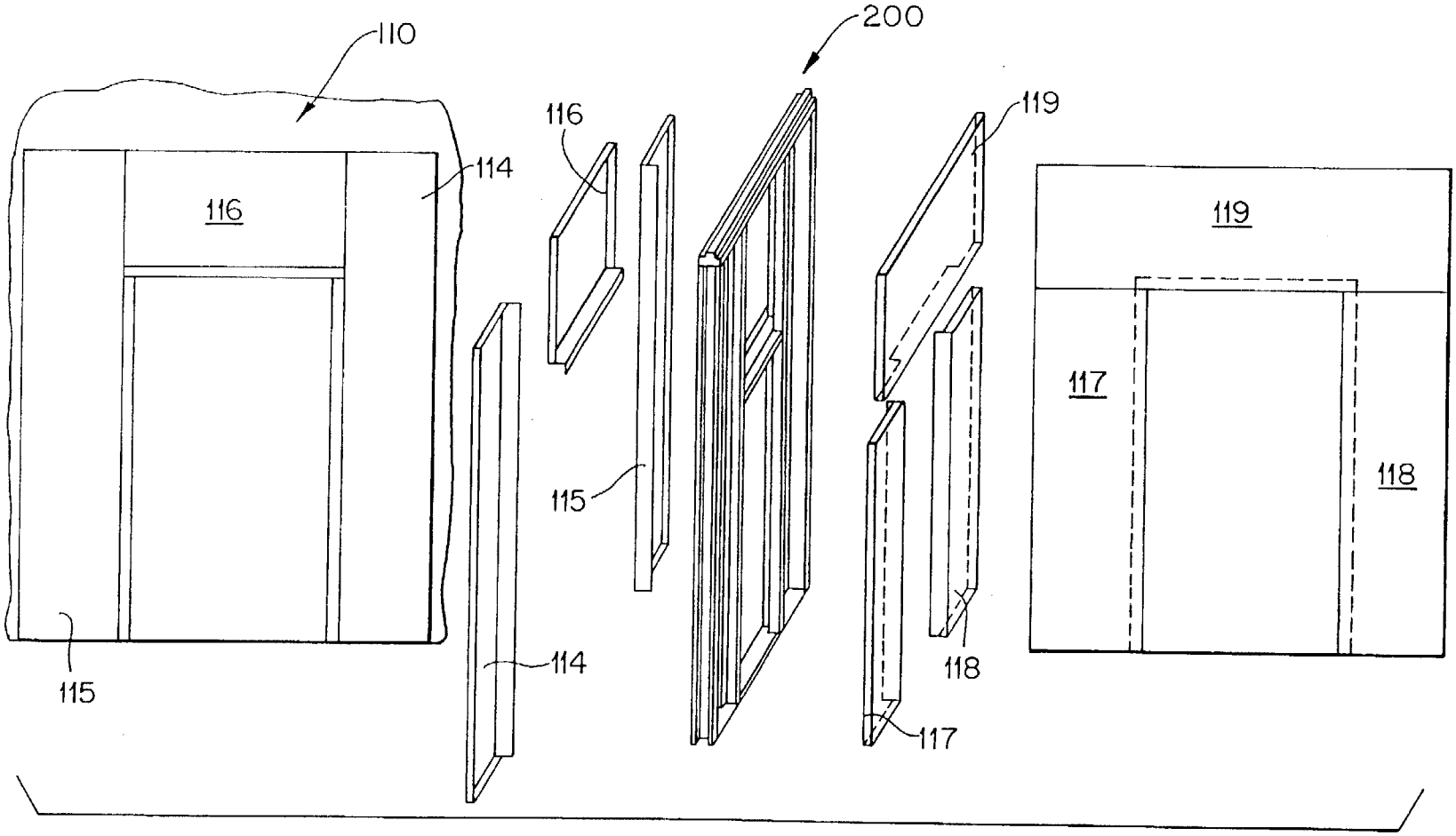
FIG. 1 is a view in perspective of the composite door frame and its sheetmetal shell, such as may be affixed to an interlocking insulative panel construction for a walk-in cooler and/or freezer. Assembled components of the shell are presented on the left in exterior and on the extreme right, interior elevation. An exploded perspective view of its basic components appear in the center.
Figure 3A:
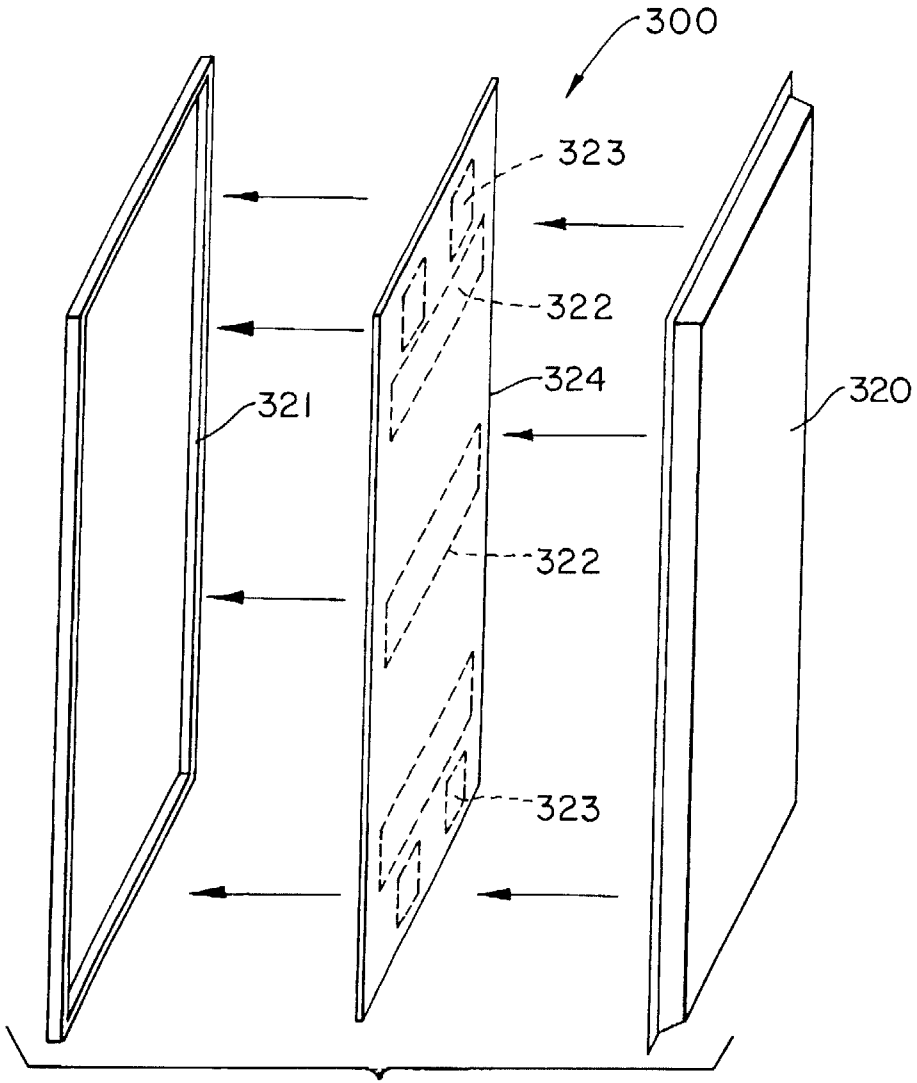
FIG. 3 is a view in fragmentary perspective of a standard door panel assembly 300 wherein its components are assembled. The unassembled panels and precut retainer, appear in exploded FIG. 3A.
Figure 3:
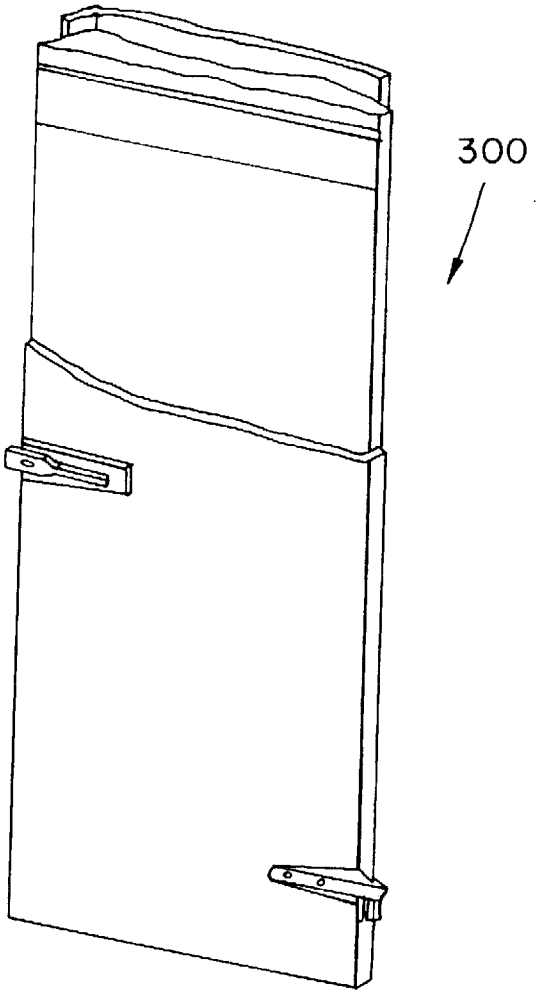

In general, the sheetmetal shell and confined door frame appear in FIG. 1. Details of the door frame likewise appear in FIGS. 2 and 4; whereas the door panel assemblies, per se are illustrated in FIGS. 3, 3A and 4A.

In FIG. 1, there are illustrated external right and left sheetmetal panel jambs 114 and 115 with corresponding exterior and interior sheetmetal header panels 116 and 119, respectively. Left interior sheetmetal panel jamb 117 is transversely opposed to right interior sheetmetal panel jamb 118. FIG. 1 furthermore shows the exploded view of the sheetmetal components of a door frame, relative to its shell, per se. As illustrated, shell 110 comprises the exterior sheetmetal header panel 116 with opposed left and right external sheetmetal panel jambs 114 and 115. In counterpart, on the interior of the shell, are left and right internal sheetmetal panel jambs in 117 and 118, the tops of which are supporting the interior sheetmetal header panel 119. As indicated, the standard door frame 200, per se is interposed between respective exterior and interior shell components 114-115-116 and 117-118-119 respectively.

Referring to FIG. 2, the door frame 200 includes boundary runners of high density urethane male hardtrack 201 extending from side-to-side in conformity with sheetmetal header panels 116–119, reference FIG. 1. Vertical hardtrack 201 also bounds the door frame on its right, and female hardtrack 202 bounds the door frame on its left. Likewise, hardtracks 201 and 202 on opposed sides of the door frame, extend vertically from the top of the frame beneath the topmost horizontal hardtrack 201 to the screed bottom 203 at the bottom. Screed bottom 203 extends fully transversely, to support threshold plate 211. See FIG. 2A. Interior door jamb frames 204 are illustrated as spaced apart from opposed exterior jamb frames 205. These jamb flames contacting respective interior and exterior header frames 206 and 207, reference FIG. 2. In actual practice, the individual steel frame members 204–205 are coupled, but spaced apart to form a thermal gap. They do not touch one another. Likewise the elements 206 and 207 are spaced apart to form a similar thermal gap, preferably to be filled with insulation. These important relationships for thermal stability are most clearly shown in the FIGS. 2 B–C, 2 F-E, 2 G–F, 2 B-A 2 A–F. The three standard door hinge backup plates 213 are illustrated in phantom in FIG. 2. They are secured by weldmerit to the exterior jamb frame 205. As noted, jamb frame elements 204 and 205 are overlapping as are respective interior and exterior header frame elements 206 and 207, the same being welded to corresponding jambframe pieces 204 and 205. Likewise, the jambframe pieces 204 and 205 are welded at bottoms to the threshold frame 211.

Schematic FIGS. 2 B-A and A–F illustrate the breakdown inside section views of a standard door frame 200 wherein the components 201/206 and 207 illustrate the relationship between male hardtrack, interior and exterior head frames, respectively. The pair elements 206/207 are spaced apart laterally.

FIG. 2 B–C refers to the breakdown off the standard door frame wherein the relationship between components 204/205 and the male hardtrack 201 are shown. The spaced-apart relationship between lefthand and righthand jamb pairs are shown in FIGS. 2 B–C and 2 F-E.

FIG. 2 F-E; 2 G-F show in vertical section, the relationship in the standard door frame between corresponding interior/exterior frame component pairs 204/205 and the vertical 202, a female hardtrack.

FIG. 2 D–E refers to the relationship between the supported threshold plate 211 and screed bottom 203.

In FIGS. 3 and 3A, the standard door panel assembly 300 is depicted. The door panel assembly consists of pan configured inside panel 320, outside panel 321 and the interposed, precut retainer 324. The inside panel 320 is shown as capable of containing foam therein. Panel 320 encompasses the retainer 324, whereas outside panel 321 fits the former panel. Door hinge strap backup plates 322, door closer backup plates 323 are glue applied to the outside panel 321. The precut retainer 324, likewise shows the disposition of coactive steel backup plates 322–323 which accommodate the hinge strap and door closer, respectively. Plates 322 function as backup plates for the door latch and self-closing cam-lift hinge and lower cam-lift hinge as well as the uppermost hinge. Backup plates for the door closer are designated 323. As indicated, the precut retainer 324 for the door panel assembly retains door panels 320 and 321 together until the door panel 300 is foamed together. The backup plates are thus glued to outside panel 321, restrained in position by the retainer 324.

More specifically as to this standard door construction, heavy 12-gauge steel strips are placed in the outside metal door pan 321 to act as backups for hardware. This reinforcement gives the door assembly 300 added strength and rigidity by evenly distributing the weight of the door across its entire width.

A heavy 14-gauge reinforcing "U" channel frame 204–205, 206–207 encompasses the perimeter of the door frame opening to give extra support and rigidity to the door frame 200, also preventing racking, distortion, warping, and twisting in transit during storage, installation, and use. See FIG. 2. Backup plates of 12-gauge steel are welded to the "U" channel frame to serve as hinge, latch, and door closer anchorments. An armored anti-sweat heater cable which is run around the entire perimeter of the door opening, not shown, is encased in masonite and removable heavy gauge stainless steel trim. The door 300 and frame 200 are foamed-in-place with urethane foam insulation.

Figure 4:
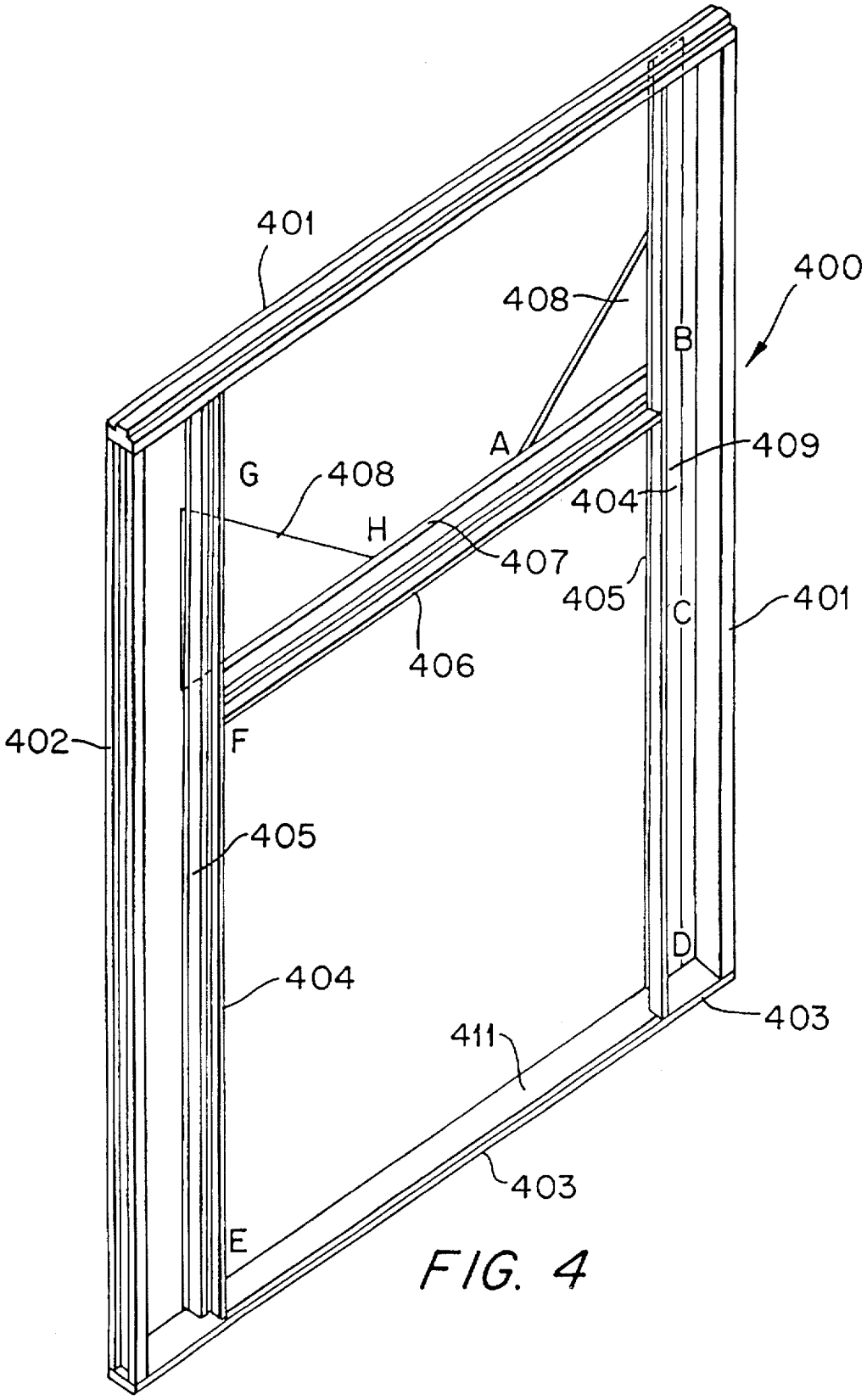
FIG. 4 is a perspective view of the assembled elements forming an oversized door frame assembly 400, related to the standard door frame assembly of FIGS. 1–2, aforesaid.
Figure 4A:
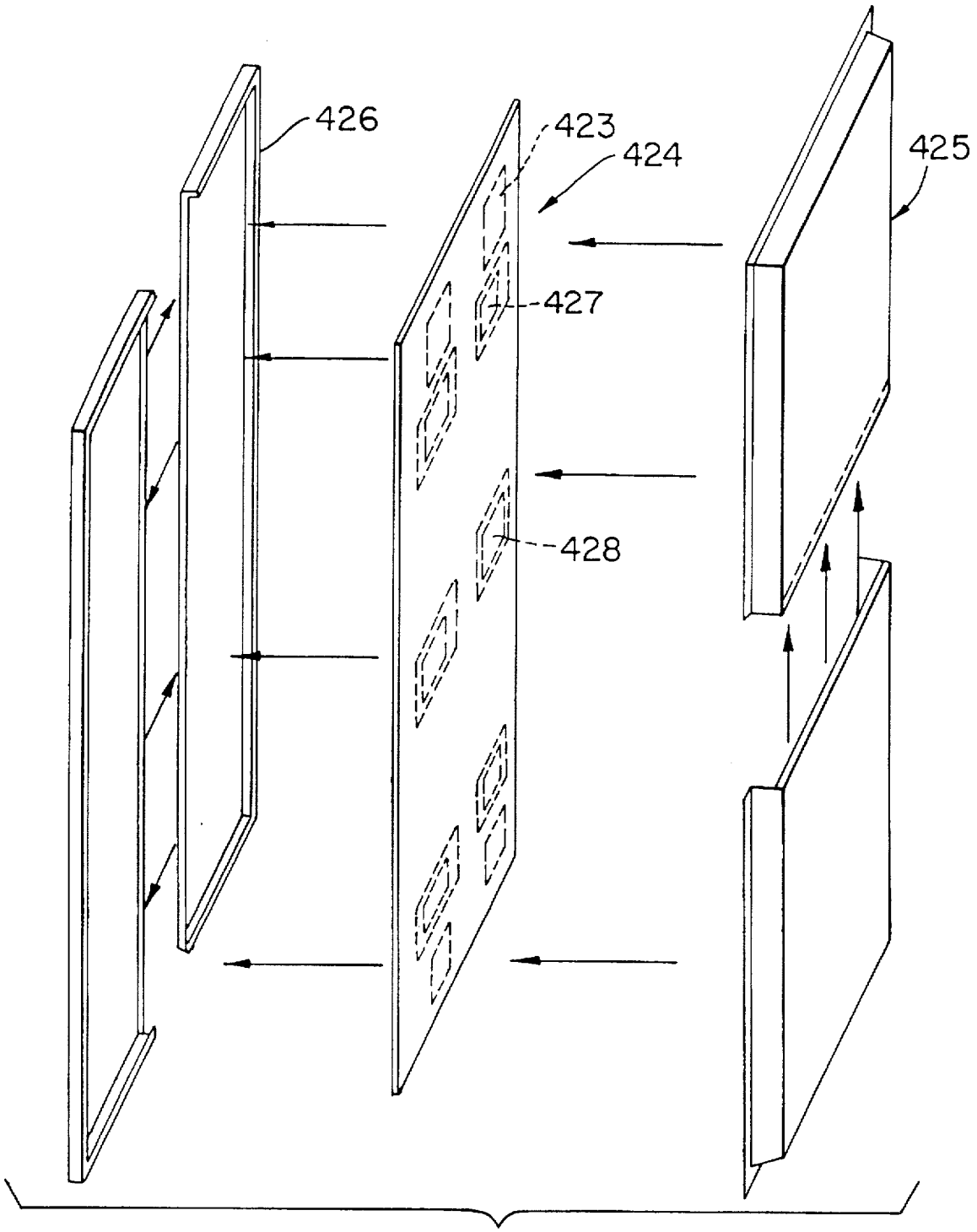
FIG. 4A is an exploded fragmentary view of an unassembled oversize door panel.

FIG. 4 illustrates the distinctions between the standard door frame 200 of FIGS. 1 and 2, and the oversize door frame 400, as well as the parts associated therewith. The door frame 400 includes male and female hardtracks 401 and 402, comparable to those of the standard unit. The screed bottom is illustrated at 403, coextensive with the width of the door frame. There are also pairs forming external and internal jamb frames 405 and 404, respectively interconnected by an interior header frame elements 406 and 407, spaced apart. The lefthand and righthand jamb frame pairs and header frame pairs of steel components are spaced apart from one another as in the aforementioned standard door frame, thus ensuring thermal gaps by substantially breaking metal-to-metal contact. Above the header frame elements 406 and 407, gussets 408 are disposed for reinforcement and a vertically extending backup plate which is coextensive with the exterior of the oversize door frame is illustrated at 409. This is otherwise defined as oversize door hinge butt backup plate. From the outside of the door frame, this oversize hinge backup plate 409 would appear on the left, customarily. The threshold plate 411 is rested contiguously on the screed bottom 403, per se.

Sections of each part of the door frame 400 are shown in phantom. See FIGS. 4C-B; 4F-E; 4B–C; 4B-A; 4G-F; 4H-F; 4A–H; and 4D–E. They illustrate how the "Z" frame is built into the door. Vertical sections 4 B-A and 4 H-F reflect the top of the door frame viewed from the same side whereas section 4A–H illustrates the relationship between the respective header frame elements 406 and 407. While FIGS. 4 F-E and 4 G-F would appear to be the same, 4 G-F illustrates in addition the disposition of the critical gusset 408 and 4 B–C, 409 the vertically extending hinge butt backup plate. FIG. 4 B–C is illustrative of the lowermost portion of the door frame which abuts the screed bottom 403 and threshold plate 411.

In FIG. 4A of an oversize door panel, the door closer backup plates are shown at the top and bottom of the outside panel where they are designated item 423. The precut retainer 424 for the door panel assembly is illustrated, together with the interior pan panel 425 and the outside panel 426. Oversize door hinge strap backup plates 427 and oversize door hinge strap mounting plates 428 are likewise shown to complete the unit. Other elements are substantially similar to those defined with respect to the standard door panel assembly 300 excepting that the outside panel 426 and inside panel 425 may be created in sections and the sections brought together vertically and transversely to form with the precut retainer 424.

DOOR CONSTRUCTION

Standard size door panels are made in 30", 34", 36" and 42" widths and 74" through 84" heights in two-inch increments. Oversize door panels are normally made in 48", 60" and 72" widths with the same heights as the standard doors. All door panels are constructed with an inner and outer metal skin. The doors inner and outer panels are assembled together with the use of a precut plastic retainer. The inside of each of the door panels are uniformly sprayed with contact bonding adhesive to permanently bond the sheetmetal to the polyurethane foam. The foam is sprayed into the door panels in the same manner that foam is sprayed into the standard panels as is described in the interlocking Insulative Panel Construction U.S. Pat. No. 5,424,118.

Oversize door sheetmetal is spliced together for added strength. Backup plates are glued on the exterior sides of the door sheetmetal. They are installed for added support of the hinge strap. The oversize doors have a thick support plate that is placed on top of the standard heavy gauge backup plate for added strength and rigidity. The backing's thick plate is drilled and tapped to securely mount the hinge strap. The door panels all have a retainer with a magnetic gasket attached between the interior and exterior door pans to seal the door panel to the door frame when the door is closed.

DOOR FRAME CONSTRUCTION

Most standard door frames are made 81 ⅜", 93 ⅜" or 99 ⅜ tall with varying widths. The construction includes a heavy sheetmetal "Z" frame. The headframe and jamb frames are shown in the drawings. Their elements are spaced from each other. The metal on the outside of the door frame is not in direct contact with the metal on the inside of the door frame at any point except where the jambframe is tack-welded to the headframe. The threshold piece at the floor is the only place where a continuous piece of metal, one piece from interior of door frame to exterior of door frame, is installed. Having the jamb frame components and headframe components each composed of two separate pieces gives the door frame excellent insulation characteristics since none of the metal on the inside of the cooler is in direct contact with the outside of the cooler. In a given door frame construction there would thus be two separate pieces for the left jamb and two for the right jamb, plus two for the headframe, a total of six.

A tongue and groove high-density urethane hardtrack is attached to the door frame with screws. These screws go through the brackets and into the hardtrack shown at the end of the jambframe. This hardtrack has had the cam locks and pins installed in them as is described in the interlocking Insulative Panel Construction Patent No. 5,424,118.

All door frames are constructed with an inner and outer metal skin. Small nails are used to hold the edges together and the contact cement that is applied to the interior of the metal skins does most of the holding. It bonds with the foam inside the finished assembly to hold the skins together. The inner and outer panels are attached to the flame and hardtrack with the use of contact cement and nails. The inside of each of the door flame panels are uniformly sprayed with contact bonding adhesive to permanently bond the sheetmetal to the polyurethane foam. The foam is sprayed into the door panels in the same manner that foam is sprayed into the panels as is described in the interlocking Insulative Panel Construction Patent No. 5,424,118. The door frame is filled with a 4" thick core of low density urethane foam insulation. Outer edges of the door flame all have double-beaded vinyl sealing gaskets applied to the exterior and interior side of all tongue perimeters as is done with the standard panels, aforesaid.

The oversize door flames are built with a thick steel hinge butt mounting plate. This plate has holes drilled and tapped into it to mount the butt of the large hinges. These oversize door flames are also built with gussets on each side to further strengthen the door.

URETHANE FOAMING TECHNIQUE

Applicant uses the froth foaming technique to produce foam which has outstanding insulating and structural properties. Froth foaming offers many advantages over the conventional pouring processes used by many manufacturers, both in terms of better foam dispersion and the quality of foam produced.

As the foam leaves the mixing equipment to enter the metal skins of the panels, an additive is converted to a gas, producing a creamy, frothy mass. This mass has excellent flow characteristics, and achieves maximum distribution throughout the panel area. Because the pre-expansion process minimizes frictional drag, frothed foam fills the panels more completely with foam at a lower density than poured foam. Cell structure is improved and skin density is reduced.

Because froth foam is self-insulating, ambient temperatures affect it less. Thus, it is less sensitive to temperature variations during manufacture, resulting in greater quality control and more uniform panels. Tests have proven that froth foam is as dimensionally stable as poured foam, and does not expand more than conventional poured foam when subjected to high ambient temperatures. The advantages offered by froth foam are achieved with no loss of dimensional stability.

Many modifications and variations of this invention are possible in light of the above teachings. I therefore intend the above terminology to illustratively describe the invention's preferred embodiment and not to limit its scope. Within the scope of the appended claims, in which reference numerals are merely for convenience and are not limiting, one may practice the invention other than as the above specification describes.

The scope of invention is thus defined in the following claims, wherein:

I claim:

1. A shall and a door frame with a door panel assembly for enclosed insulative panel construction comprising:

a) a sheetmetal shell (110) composed of left and right external sheetmetal panel jambs (114–115) and opposed left and right internal sheetmetal panel jambs (117–118), opposed exterior and interior header panels (116–119) supported thereby;

b) a door frame assembly (200) bounded on three sides by hardtrack runners (201–202); a pair of vertically upstanding jamb frame runners (204–205) extending from the base of the hardtrack in spaced-apart relation to each other; spaced-apart header frames members (206–207), intermediate of vertical ends of the pairs of jamb frame members and a threshold (211) extending between each pair of vertical jamb frame runners (204–205), the threshold being welded to the pairs of jamb frames (204–205) at the base thereof, said jamb frames (204–205) on one side of the door frame bearing spaced-apart door hinge backup plates (213);

c) a door panel (300) including a pan configured inside panel (320), interfitting an outside panel (321) and an interposed precut retainer (324) wherein spaced-apart door hinge strap backup plates (322) are set upon the outside panel (321) as also are door closer backup plates (323);

d) applied foamed insulation, whereby thermal gaps between metal skins of components of respective sheetmetal shell, door frame and door components are thermally protected.

2. The shell and door frame with a door panel assembly of claim 1 wherein the hardtrack runners (201) and (202) are composed of a urethane composite plastic substance.

3. The shell and door frame with a door panel assembly of claim 2 wherein the door frame (200) is a composite of two exterior male hardtrack runners (201) joined as horizontal and vertical encasement members, a female hardtrack runner (202) and screed bottom (203) completing the frame encasement, a door frame within the encasement composed of pairs of spaced-apart interior and exterior metal jamb frame members (204–205), joined by weldment of interior and exterior header frame rails (206) and (207), said rails engaging pairs of jamb frame members (206–207) by weldment intermediate of ends of the jamb frame members, the topmost and bottommost ends of the pairs of rails (204) and (205) being fixed to the hardtrack runner (201) and threshold plate (211), respectively.

4. A shall and a door frame with a door panel assembly for enclosed insulative panel construction comprising:

a) a sheetmetal shell (110) composed of left and right external sheetmetal panel jambs (114–115) and opposed left and right internal sheetmetal panel jambs (117–118), opposed exterior and interior header panels (116–119) supported thereby;

b) an oversize door frame assembly (400) bonded on three sides by hardtrack runners (401–402); a pair of vertically upstanding jamb frame runners (404–405) extending from the base of the hardtrack runner in spaced-apart relation to each other; spaced-apart header frames members (406–407), intermediate of vertical ends of the pairs of jamb frame members and a screed bottom (403) extending between respective vertical hardtrack members (401–402), the threshold (411) being welded to the pairs of jamb frame runners (404–405) at the base thereof, said jamb frame runners (404–405) on one side of the door frame bearing door hinge backup plate (409); lefthand and righthand gussets (408) disposed upon the header frame;

c) an oversize door panel including a segmented pan configured inside panel (425) interfitting a segmented outside panel (426) and an interposed precut retainer (424) wherein door closer backup plates (423), spaced-apart door hinge strap backup plates (427) are set upon the retainer as also are door hinge strap mounting plates (428);

d) applied foamed insulation, whereby thermal gaps between metal skins of components of respective sheetmetal shell, door frame and door components are thermally protected.

5. The shell and door frame with a door panel assembly of claim 4 wherein a precut retainer (424) secures thereto door closer backup plates (423), hinge strap backup plates (427) and hinge strap mounting plates (428), all said plates being disposed in spaced-apart relationship, commensurate with disposition of door closer means and hinge straps.

* * * * *